US005401907A

United States Patent [19]

Stangl et al.

[11] Patent Number: 5,401,907

[45] Date of Patent: Mar. 28, 1995

[54] SOLDERING TERMINAL PLATE FOR LOUDSPEAKERS

[75] Inventors: Anton Stangl; Martin Hummel, both of Straubing, Germany

[73] Assignee: Nokia Technology GmbH, Pforzheim, Germany

[21] Appl. No.: 102,651

[22] Filed: Aug. 5, 1993

[30] Foreign Application Priority Data

Aug. 6, 1992 [DE] Germany ..... 9210534 U

[51] Int. Cl.[6] ..... H01R 9/22

[52] U.S. Cl. ..... 174/94 R; 381/24; 381/205

[58] Field of Search ..... 174/94 R; 181/141, 148, 181/157; 381/86, 205, 24

[56] References Cited

U.S. PATENT DOCUMENTS

| | | | |
|---|---|---|---|
| 3,758,703 | 9/1973 | Golden et al. | 174/84 C |
| 4,191,865 | 3/1980 | King et al. | 381/205 |
| 4,502,149 | 2/1985 | Gefvert | 381/24 |
| 4,719,322 | 1/1988 | Guzik et al. | 181/141 |
| 4,812,601 | 3/1989 | Lothar | 174/94 R |
| 4,815,558 | 3/1989 | Krainhofer | 181/141 |
| 4,922,058 | 5/1990 | Rodriques | 174/94 R |
| 4,923,032 | 5/1990 | Nuernberger | 181/150 |
| 4,963,699 | 10/1990 | Urushibata et al. | 174/88 R |

FOREIGN PATENT DOCUMENTS

| | | |
|---|---|---|
| 150744 | 8/1985 | European Pat. Off. . |
| 224308 | 6/1987 | European Pat. Off. . |
| 3529453 | 2/1987 | Germany . |

*Primary Examiner*—Morris H. Nimmo
*Attorney, Agent, or Firm*—Ware, Fressola, Van der Sluys & Adolphson

[57] ABSTRACT

According to the state of the art, it is known to link the soldering terminal plates (10) of loudspeakers by riveting them to the loudspeaker frame. It is also known to relieve the strain on loudspeaker connection cables, which extend between the soldering terminal plate (10) and the signal source. According to the state of the art, this is accomplished most of the time by pressing the connection cable with a so-called cable tie against the magnet system of the loudspeaker. It is furthermore known to clamp the connection cable with a bracket formed on the loudspeaker frame (12). To simplify the production, the invention equips the soldering terminal plate (10) with catch hooks (13), which securely attach the soldering terminal plate (10) to the loudspeaker frame (12), after linking it to the crosspiece (11). The strain-relief for the connection cable (22) is established in such a way, that a safety bolt (18) can be inserted into openings (16) in the soldering terminal plate (10). When the safety bolt (18) has reached its final position on the soldering terminal plate (10), the safety bolt (18) locks onto the soldering terminal plate (10). The shape of the soldering terminal plate (10) and the safety bolt (18) is such, that when the safety bolt (18) has reached its final position, it clamps down on a connection cable (22) that is placed between these two components. This provides an effective strain-relief in the area of the soldering terminal plate (10).

4 Claims, 5 Drawing Sheets

SOLDERING TERMINAL PLATE FOR LOUDSPEAKERS

TECHNICAL FIELD

The invention concerns itself with the development of loudspeaker soldering terminal plates, particularly with attaching the soldering terminal plate to the loudspeaker, and securing the loudspeaker connection cables.

BACKGROUND OF THE INVENTION

In general, loudspeakers are built so that their conductors, which contact the oscillating coil of the loudspeakers, lead from the oscillating coil to a soldering terminal plate on the loudspeaker frame, where they are soldered to soldering terminals on the terminal plate. According to the state of the art, the link between soldering terminal plate and loudspeaker is mostly realized by attaching the soldering terminal plate to the loudspeaker frame with a rivet. However, this type of connection has drawbacks with respect to efficient production. The reason is that, during the manufacturing process, the soldering terminal plate must first be held to the connection place on the frame by a tool, the rivet must be inserted through the soldering terminal plate and an opening in the loudspeaker frame, before the riveting can take place.

The contact between the loudspeaker and the signal source is mostly realized by soldering a connection line to the soldering terminals. It is also known to equip the soldering terminal plate with tongue-sockets, into which plugs, which are linked to the connectors, are inserted. Above all, with the contact mentioned first, but also with the contact in accordance with the contact plug technique, it may be necessary to provide a strain-relief for the connection cables. This applies particularly when the loudspeakers are delivered to the consumer with the connection cables already attached; in that event it cannot be excluded that the heavy loudspeakers may be transported by their connection cables. The result of such treatment is that the connection cables are torn off if no strain-relief has been provided. A possible strain-relief for loudspeaker connection cables is the use of so-called cable ties, which press the connection cable against the magnet system, after attachment to the soldering terminal plate, for example. It is also known to form a protruding clip on the loudspeaker frame, which presses the connection cable against the loudspeaker frame when the cable is located between the clip and the loudspeaker frame.

Since the connection cables are flexible, it is easy to see that the realization of the strain-relief according to the state of the art can only be automated by means of disproportionate expense. For this reason, the strain-relief is mostly accomplished by hand, after the connection cable has been attached to the soldering terminal plate.

That is the reason the invention has the task of presenting a soldering terminal plate, which can be attached to the loudspeaker frame in a simple way. A further task of the invention is to present a strain-relief for loudspeaker connection cables, which can be automated in a simple way.

SUMMARY OF THE INVENTION

The first-named task is fulfilled by forming catch hooks on the soldering terminal plate which, when this plate is attached to the loudspeaker, have fingers which lock onto protrusions on a back side of a crosspiece of the loudspeaker frame and by themselves establish a strong link between loudspeaker and soldering terminal plate.

If the protrusions, behind which the catch hooks of the soldering terminal plate lock in case of a loudspeaker and soldering terminal plate connection, are located in at least one of the loudspeaker frame ribs, such protrusions can be formed during manufacture of the loudspeaker frame, without any additional labor.

The further task of the invention is fulfilled in that a safety bolt can be inserted and locked to the soldering terminal plate, which secures the catch hooks in their position when they are locked behind the protrusions of the loudspeaker frame, and in that the safety bolt is so constructed, that, when locked to the soldering terminal plate, it simultaneously pinches a cable leading from the loudspeaker to the signal source, when this cable is placed on the soldering terminal plate, squeezing it between the soldering terminal plate and the safety bolt. Since the safety bolt secures the catch hooks of the soldering terminal plate in their position behind the protrusions by exerting considerable force on the soldering terminal plate, thus preventing the catch hooks from moving, the soldering terminal plate can no longer be separated from the loudspeaker without damage. This does not mean that the soldering terminal plate must be equipped in all instances with a safety bolt. Rather, the soldering terminal plate indicated can also be used without a safety bolt in cases of low tensile strain. If the loudspeaker connection cable is subject to considerable tensile strain, the use of the safety bolt simultaneously performs a strain-relief when the safety bolt is so constructed that, when attached to the soldering terminal plate, it presses a cable placed on the soldering terminal plate, against that plate. Forming the strain-relief directly on the soldering terminal plate is also particularly advantageous, because the strain-relief formation can thus be automated in a very simple manner. This result can be attributed to the fact that the connection cable contact requires it anyway to be secured in the soldering terminal plate area, so that, without any renewed gripping of the cable, it is pressed against the soldering terminal plate in a strain-relief manner, solely by the installation of the safety bolt.

BEST MODE FOR CARRYING OUT THE INVENTION

The invention will now be explained in more detail by means of the figures.

Figure 1:
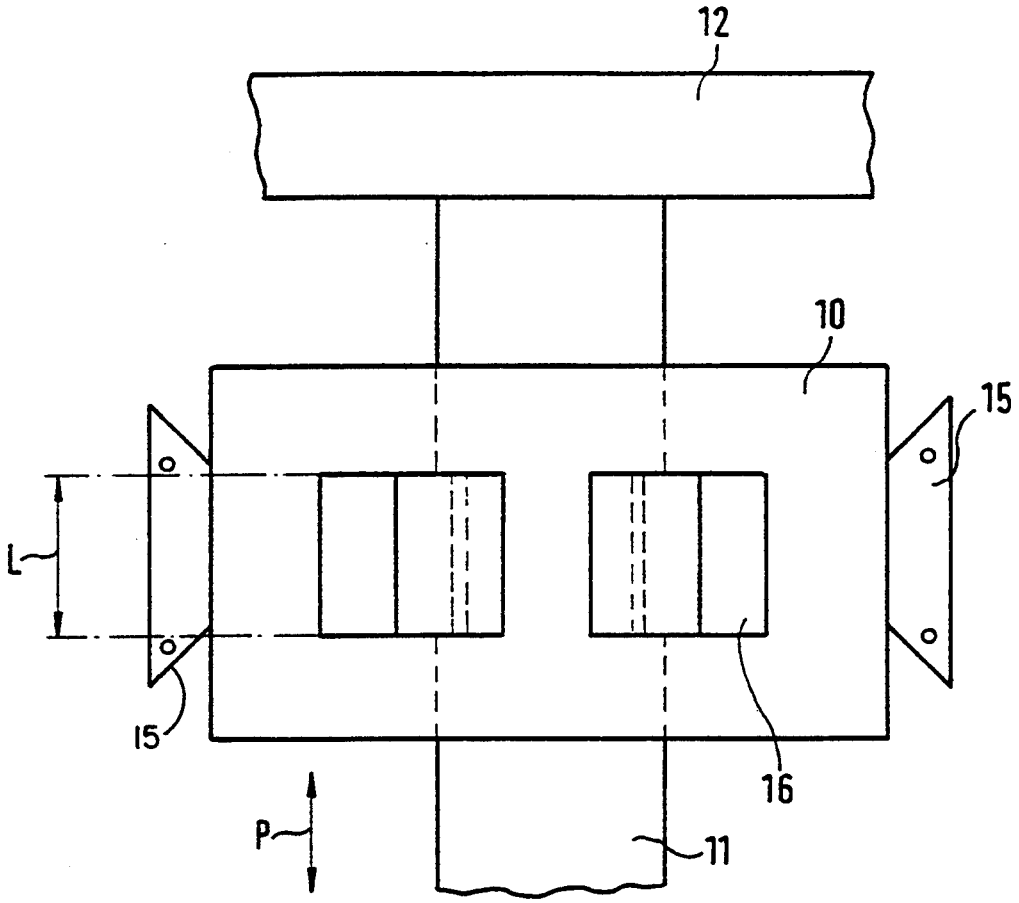
FIG. 1 shows the top view of a soldering terminal plate.
Figure 2:
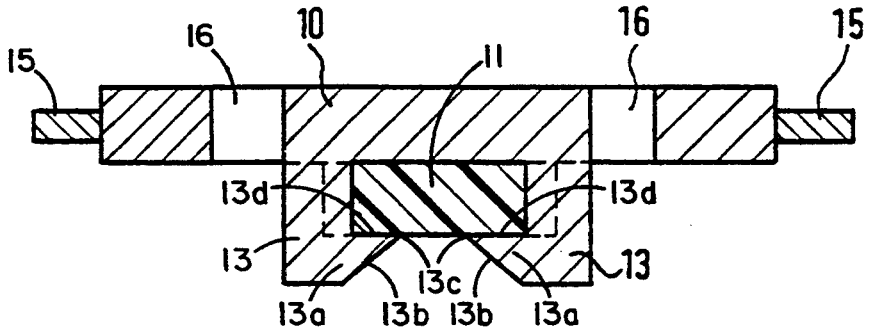
FIG. 2 shows a side view representation of the soldering terminal plate.

The top view in FIG. 1 shows a soldering terminal plate 10, which is connected to a crosspiece 11 of a loudspeaker frame 12. The cross section of the crosspiece 11 narrows in the area where the soldering terminal plate 10 is located. As clearly shown in FIG. 2, the soldering terminal plate is locked to the crosspiece 11. To that effect, catch hooks 13 are formed on the side of the soldering terminal plate 10 facing the crosspiece 11, which, when the soldering terminal plate 10 is linked to crosspiece 11, have fingers 13*a* which lock on protrusions 14 formed by a protruding rim 14 along the back surface of the crosspiece profile. The length (L) of catch hooks 13 corresponds to the length of the narrowed crosspiece profile. This ensures that the soldering terminal plate 10 is locked to the crosspiece 11 and cannot move in the direction of the arrows (P) (FIG. 1). As shown in FIG. 2, the catch hooks 13 have fingers 13*a* each with slanted faces 13*b* for sliding over top edges of the crosspiece 11 for expanding outwardly the catch hooks 13 from their original position, each with ends 13*c* for sliding along sides of the crosspiece 11 and sliding passed bottom edges of the crosspiece 11 for contracting inwardly the catch hooks 13 to their original position, and each with contacting faces 13*d* for sliding inwardly along and contacting a rear surface of the crosspiece 11, to attach the soldering terminal plate 10 to the loudspeaker frame 12.

Soldering terminals 15 are located on the soldering terminal plate 10. The soldering terminals 15 will serve later to connect the loudspeaker wires and the connection cables (not shown). Openings 16 are made in the soldering terminal plate 10 on both sides of the catch hooks 13. These openings 16 serve to receive the legs 17 of safety bolt 18.

Figure 3:
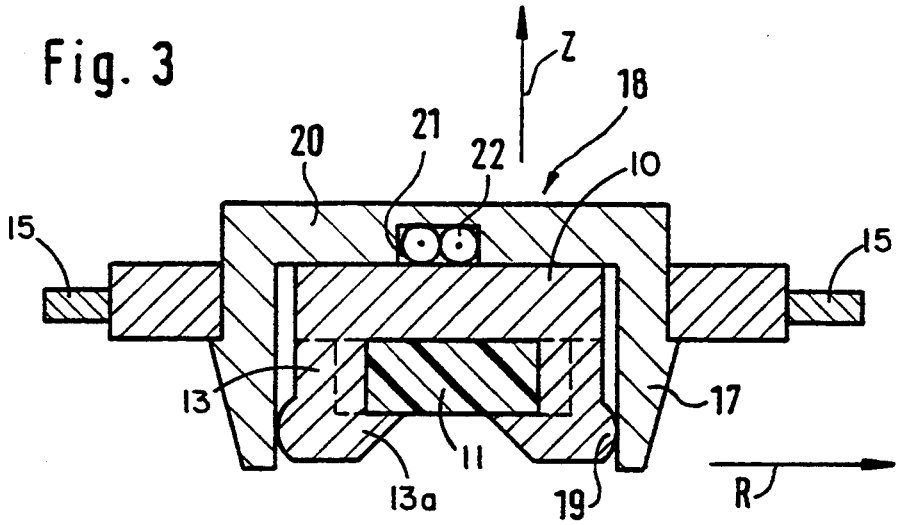
FIG. 3 is a side view of a soldering terminal plate with a safety bolt.

This situation is described in more detail in FIG. 3. Both legs 17 of safety bolt 18 have been inserted into the openings 16. The legs 17 are also shaped like catch hooks and, when the safety bolt 18 is linked to soldering terminal plate 10, they lock onto the underside of soldering terminal plate 10. The constructed length of legs 17 is so dimensioned, that it corresponds approximately to the length of the catch hooks 13 of soldering terminal plate 10. The ends of the catch hooks 13 have protrusions 19 on the side facing the legs 17, which contact the legs 17 in their final position in the soldering terminal plate 10. This ensures that the catch hooks 13 cannot escape in the direction of arrows (R) and release the soldering terminal plate 10, when subjected to the effects (Z) of tensile stress.

Both legs 17 of safety bolt 18 are linked to each other by the intermediate piece 20. In the example shown in FIG. 3, this intermediate piece 20 is located directly on the soldering terminal plate 10 when the safety bolt 18 is in its final position on soldering terminal plate 10. A slot 21 is machined in the middle of the intermediate piece 20, into which the connection cable 22 is inserted. The height of the slot 21 is so dimensioned that, when the connection cable 22 is inserted, this cable 22 is pressed by the intermediate piece 20 against the soldering terminal plate 10, when the safety bolt 18 is in its final position in the soldering terminal plate 10. This provides an effective strain-relief for the connection cable 22 in the area of the soldering terminal plate 10.

It should be pointed out that the safety bolt 18 shown in FIG. 3 can also be used without an inserted connection cable 22. In that case, the safety bolt 18 only has the function of securing the position of the catch hooks 13 on the crosspiece 11.

Figure 4:
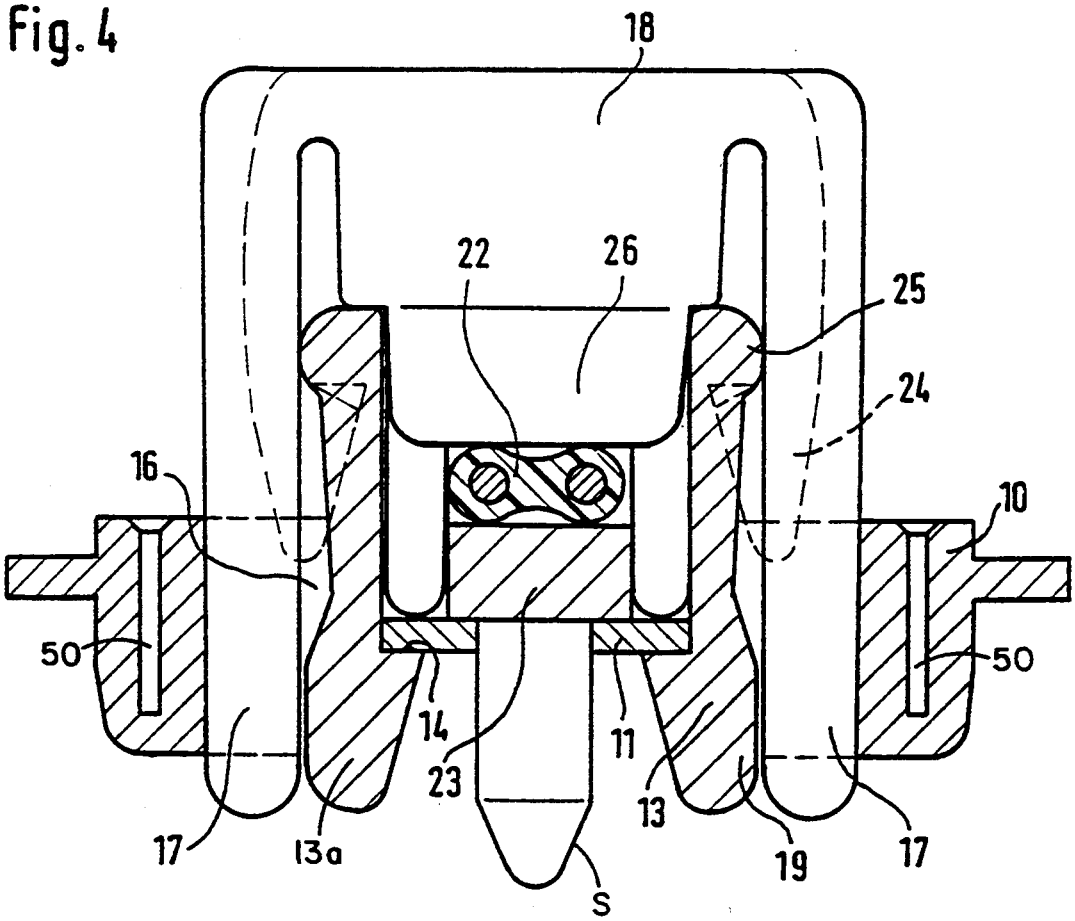
FIG. 4 is a side view of another soldering terminal plate with safety bolt.

FIG. 4 shows a different form of the soldering terminal plate 10 than FIG. 3, with the safety bolt 18 inserted and locked.

The soldering terminal plate 10 has a spindle 5 that is inserted through an opening in crosspiece 11. This spindle 5 makes it easier to align the soldering terminal plate 10 and the crosspiece 11 precisely. As soon as the soldering terminal plate 10 is placed on the crosspiece 11 (as illustrated in FIG. 4), the catch hooks 13 on the soldering terminal plate 10 have fingers which lock on the protrusions 14 formed by a protruding rim 14 along behind the back surface of the crosspiece 11. If the connection of the cable 22 to the soldering terminals (not shown in FIG. 4) is then established, the connection cable 22 may be located on the supporting bed 23. This is particularly advantageous, because the connection cable 22 can be held at a short distance from the soldering terminals (not shown in FIG. 4). After completion of the soldering procedure, the safety bolt 18 can be placed on and locked to soldering terminal plate 10. To that effect, the smooth legs 17 of safety bolt 18 are inserted through the openings 16 in soldering terminal plate 10. Contrary to the configuration in FIG. 3, the legs 17 of safety bolt 18 in FIG. 4 have smooth sides. In the configuration example shown in FIG. 4, these smooth-side legs 17 only have the task of securing the position of catch hooks 13 over the protrusions 19, preventing any release of the catch hooks 13 under the effect of tensile stress. The connection between soldering terminal plate 10 and safety bolt 18 is established by the independent catch hooks 24 formed on safety bolt 18 (shown by dashed lines). These catch hooks 24 lock behind the nose 25 located on soldering terminal plate 10, as soon as the safety bolt 18 has reached its final position on soldering terminal plate 10. A die 26 is located on the head of safety bolt 18. When the catch hooks 24 have latched behind nose 25, this die 26 presses against the connection cable 22 located on the supporting bed 23. This provides a simple and effective strain-relief for cable 22.

Figure 4A:
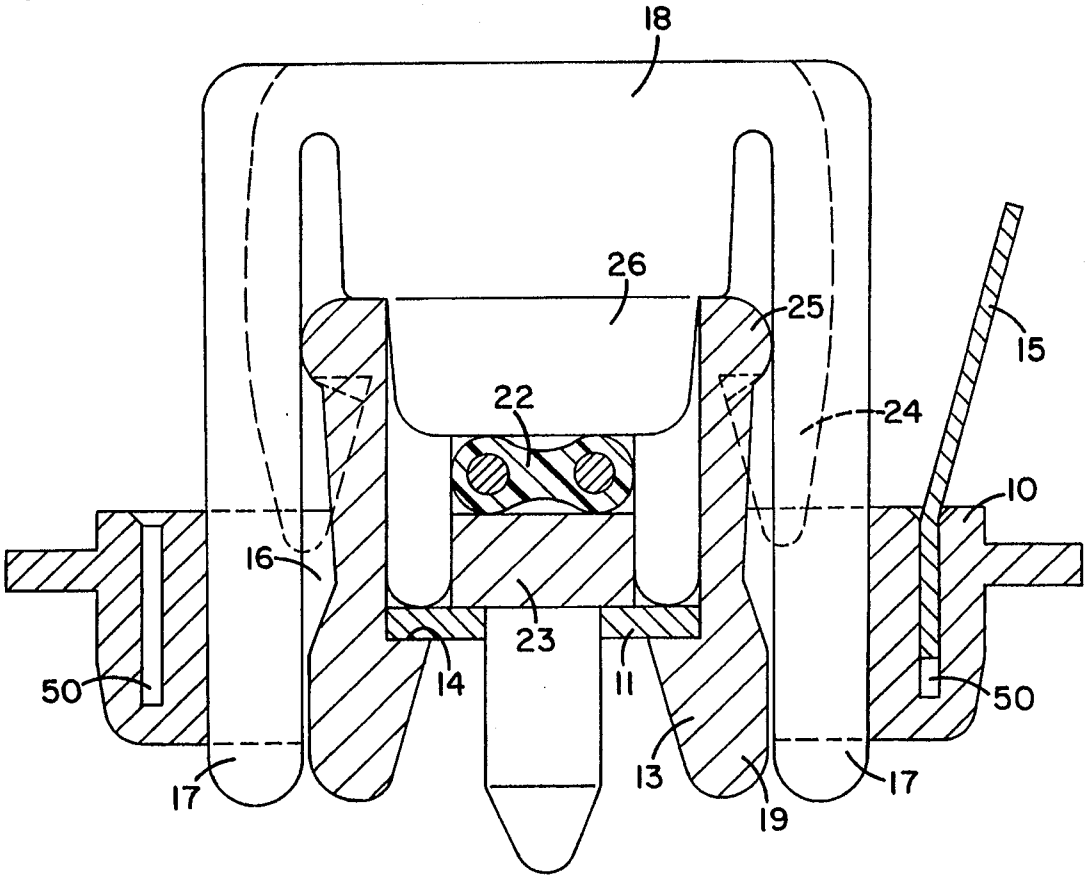
FIG. 4*a* shows a view similar to FIG. 4 with the soldering terminals 15 inserted in the slots 50.

FIG. 4*a* shows a view similar to FIG. 4 with the soldering terminals 15 inserted in the slots 50.

Figure 4B:
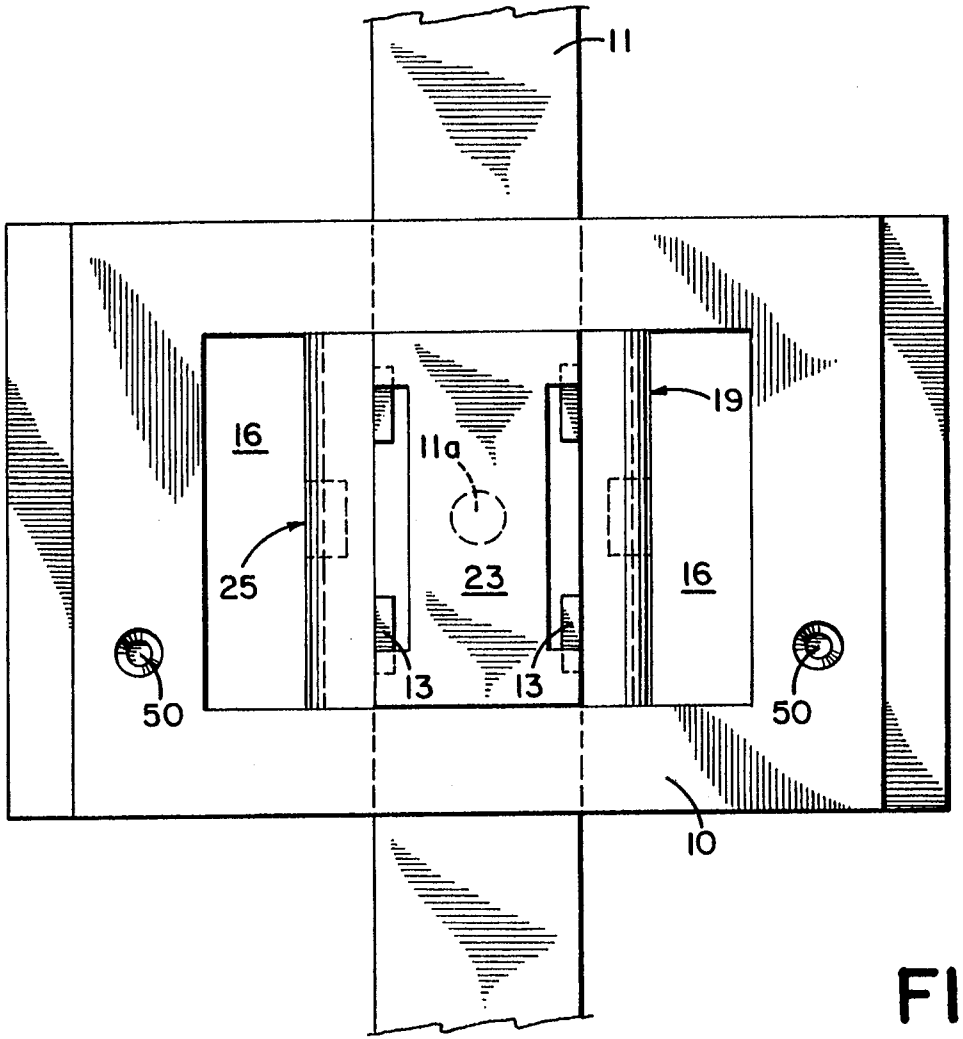
FIG. 4*b* shows a top view of the soldering terminal plate shown in FIG. 4.

FIG. 4*b* shows a top view of the soldering terminal plate shown in FIG. 4.

Figure 5:
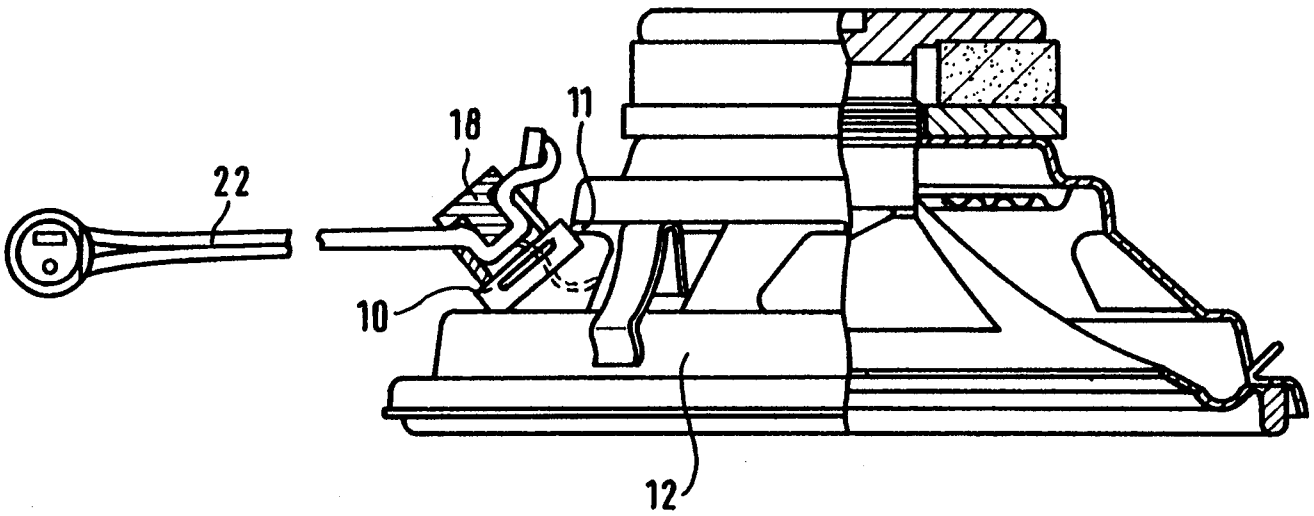
FIG. 5 is a side view of a loudspeaker.

FIG. 5 shows an installation example of a soldering terminal plate 10 with mounted safety bolt 18 according to FIG. 4. The soldering terminal plate 10 and the safety bolt 18, are placed as a unit on the side of a crosspiece 11 of loudspeaker frame 12. It can clearly be seen in FIG. 5 that, because of the special shape of the soldering terminal plate 10 and safety bolt 18, the connection cable 22 is clamped in a meandering way between the two above cited components. This type of soldering terminal plate 10 and safety bolt 18 configuration provides a particularly effective strain-relief for connection cable 22.

We claim:

1. A soldering terminal plate (10) for loudspeakers having a loudspeaker frame (12) with a crosspiece (11), characterized in that catch hooks (13) are formed on the soldering terminal plate (10), having fingers (13*a*) for locking on protrusions (14) on a back surface of the crosspiece (11) of the loudspeaker frame (12) and for providing a strong attachment between the loudspeaker frame (12) and the soldering terminal plate (10).

2. A soldering terminal plate for loudspeakers according to claim 1, characterized in that the protrusions (14) are a protruding rim (14) along the back surface of a profile of the crosspiece (11) of the speaker frame (12).

3. A soldering terminal plate according to claim 1, characterized in that the catch hooks (13), when locked behind the protrusions (14), are secured to the protrusions (14) in that position by means of a safety bolt (18), which can be inserted and locked to the soldering terminal plate (10), and the safety bolt (18) is constructed in such a way, that when it is inserted and locked to the soldering terminal plate (10), it simultaneously pinches a connection cable (22) placed on the soldering terminal plate (10) and leading from there to the signal source, and squeezes it between the soldering terminal plate (10) and safety bolt (18).

4. A soldering terminal plate (10) for coupling soldering terminals (15) to a loudspeaker frame (12) with a crosspiece (11), comprising:

catch hooks (13) being made of a resilient material, having fingers (13*a*) each with slanted faces (13*b*) for sliding over top edges of the crosspiece (11) for expanding outwardly the catch hooks (13), each with ends (13*c*) for sliding along sides of the crosspiece (11) and sliding passed bottom edges of the crosspiece (11) for contacting inwardly the catch hooks (13), and each with contacting faces (13*d*) for sliding inwardly along and contacting a rear surface of the crosspiece (11), whereby the soldering terminal plate (10) is strongly attached to the loudspeaker frame (12).

* * * * *